United States Patent [19]

Ostertag et al.

[11] Patent Number: 4,803,143

[45] Date of Patent: Feb. 7, 1989

[54] COLORED SINGLE-COMPONENT TONERS AND THEIR PREPARATION

[75] Inventors: Werner Ostertag, Gruenstadt; Erwin Czech, Darmstadt; Franz-Ulrich Schmitt, Gerlingen; Detlef Schulze-Hagenest, Stuttgart, all of Fed. Rep. of Germany

[73] Assignee: BASF Aktiengesellschaft, Rheinland-Pfalz, Fed. Rep. of Germany

[21] Appl. No.: 936,312

[22] Filed: Dec. 1, 1986

[30] Foreign Application Priority Data

Dec. 4, 1985 [DE] Fed. Rep. of Germany ..... 3542834

[51] Int. Cl.[4] ..... G03G 9/08; G03G 9/14

[52] U.S. Cl. ..... 430/106.6; 430/111; 430/903

[58] Field of Search ..... 430/106.6, 111, 903

[56] References Cited

U.S. PATENT DOCUMENTS

| | | | |
|---|---|---|---|
| 4,150,173 | 4/1979 | Ziolo | 427/130 |
| 4,238,558 | 12/1980 | Ziolo | 430/108 |
| 4,262,076 | 4/1981 | Hakumoto et al. | 430/106.6 |
| 4,270,060 | 6/1981 | Sypula et al. | 430/106 |
| 4,433,042 | 2/1984 | Kawanishi et al. | 430/106.6 X |
| 4,474,486 | 10/1984 | Ziolo | 430/106.6 |
| 4,518,674 | 5/1985 | Watanabe et al. . | |

FOREIGN PATENT DOCUMENTS

| | | | |
|---|---|---|---|
| 0048762 | 4/1982 | European Pat. Off. . | |
| 75346 | 3/1983 | European Pat. Off. . | |
| 0109860 | 5/1984 | European Pat. Off. . | |
| 62-14166 | 1/1987 | Japan | 430/106.6 |

*Primary Examiner*—Roland E. Martin

*Attorney, Agent, or Firm*—Oblon, Fisher, Spivak, McClelland & Maier

[57] ABSTRACT

Colored single-component toners essentially consist of a magnetic pigment, a binder based on an organic polymer and/or a wax, a dye or colored pigment homogeneously distributed in the binder, and other assistants, the magnetic pigment being iron powder which has a spherical or elliptical shape.

5 Claims, 1 Drawing Sheet

COLORED SINGLE-COMPONENT TONERS AND THEIR PREPARATION

Figure 1:
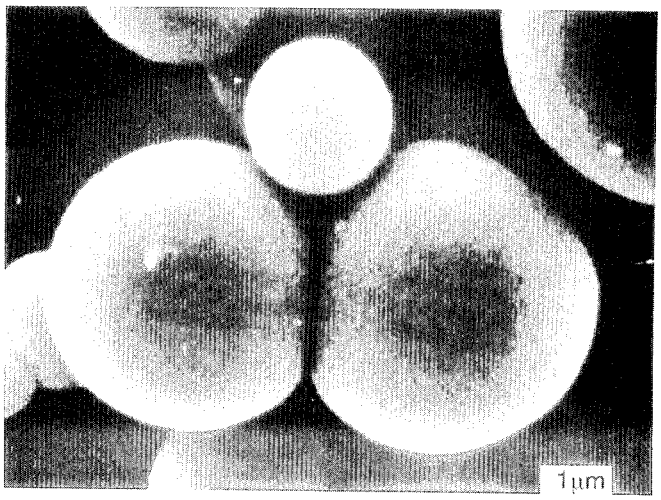

The present invention relates to colored singlecomponent toners which essentially consist of a magnetic pigment, a binder based on an organic polymer and/or a wax, a dye or colored pigment homogeneously dispersed in the binder, and further assistants.

Single-component toners are known. In addition to the conventional components, binder and magnetic pigment, they also contain assistants such as antioxidants, additives which can be adjusted to have a certain electrostatic charge capacity and, if required, silica which has been rendered hydrophobic and serves as an externally applied fluidizing agent. Black single-component toners, in particular, have frequently been described (inter alia in U.S. Pat. No. 4,270,600). In these toners, magnetite is generally the preferred magnetic component, while ferrites, iron powder and chromium dioxide are virtually never used. The toner particles, which on average are from 5 to 25 $\mu$m in size, are used in a large number of reprographic techniques for printing and copying purposes, for example in the field of electrophotography (xerography), electrography and magnetography.

Recently, however, there has been increasing interest in colored single-component toners. These differ from the black ones in that they contain, in addition to the abovementioned components, colored pigments or dyes, depending on whether red, yellow or blue toners or toners of other colors are desired for copying or printing purposes.

The problem encountered in preparing colored toners is that the magnetic pigments used, in particular the magnetite but also the finely divided metal powders or the chromium dioxide, are black and the ferrites or iron oxides which are also known are brown, so that dull, dark mixed colors are always obtained when toners of this type are colored. Another problem in the development of colored toners arises from the binder requirement of the colored pigments, which is generally very high. Consequently, the colored pigments additionally incorporated into the single-component toner composition have an adverse effect on the fixing properties of the toner particles.

There has been no lack of attempts to overcome these disadvantages. For example, Japanese Preliminary Published Application No. 7441/1985 describes the development of a ferrimagnetic mixed phase pigment $ZnO_x$-$FeO_1$-$xFe_2O_3$ in which the dark color of the $Fe_3O_4$ is lightened by means of $ZnFe_2O_4$. However, the brownish yellow mixed phase system only permits the preparation of ocher to reddish brown single-component toners, so that the toners described here constitute a special case and are not important for the general development of colored toners. Similar procedures are described in Japanese Preliminary Published Application Nos. 197047/1984, 6952/1985 and 7438/1985.

Japanese Pat. Nos. 119,200, 159,019, 185,737 and 185,738 describe a method based on a different principle. Here, the magnetic powder is coated with a white opaque substance so that the pigment masked in this manner can then be incorporated into a colored binder or a binder containing a colored pigment. For example, the magnetic powder can be treated with a titanium coupling agent, such as a titanic acid ester which undergoes hydrolytic decomposition, the $TiO_2$-containing hydrolysis product being deposited in the form of a film on the magnetic pigment. Magnetic metals, magnetite, $\gamma$-$Fe_2O_3$ and ferrites have been mentioned as magnetic materials. The disadvantage of all masked magnetic pigments prepared by such an encapsulation method is that in practice it is difficult to provide the magnetic particles with homogeneous coatings and the titanium hydrolysis products readily react with the magnetic material on dehydration at elevated temperatures and then become brown and dark. Moreover, because of the known moisture sensitivity of the systems, it is a disadvantage to employ any water-containing hydrolysis products at all, and finally $TiO_2$ is present in an undesirable, optically active form which adversely affects the binder. EP-A-75,346 describes a somewhat different procedure. Here, colored single-component toners are prepared by a method in which a magnetizable conglomerate of a thermoplastic binder and fine magnetic particles is enclosed in the center of a toner particle. This magnetizable conglomerate is prepared by a spray drying method and then masked with titanium dioxide and colored with dyes in aqueous suspension by the Kema Nord process. Important disadvantages of this method are that it is technically complicated, the magnetizable conglomerate is predominantly obtained in a dark and opaque form owing to the fine magnetic powders, and, as a result of heating, a loss of permeability occurs in some cases in the spray drying process owing to oxidation reactions of the metallic magnetic particles. Furthermore, the core is magnetically relatively weak since it is extended with resin.

Another possible method of preparing colored toners is based on the concept of very fine particles. Here, an attempt is made to produce colored single-component toners by preparing extremely small magnetic particles ($<$200 A) which, because of their small size, are optically transparent and therefore can more easily be covered with a colored pigment. For example, U.S. Pat. No. 4,238,558 describes a polymer system which is impregnated with a very finely divided metal or metal oxide and has a low optical density, U.S. Pat. No. 4,150,173 describes the preparation of transparent metallic and oxide magnetic material on a silicone-containing carrier, and U.S. Pat. No. 4,474,866 describes an ion exchange resin in which very small magnetizable particles are trapped. Apart from the difficulty of preparing very fine particles in a reproducible manner the disadvantage of all these developments is that the basic concept does not permit a drastic reduction in the color strength of the magnetic particles but only reduces their hiding power. Moreover, the magnetizability is greatly reduced since such finely divided ferromagnetic or ferrimagnetic materials are only superparamagnetic. Thus, corresponding toner materials possess only about 1/30th of the conventional magnetization.

It is an object of the present invention to provide colored single-component toners in light hues, which do not possess the above disadvantages. In particular, it is an object of the present invention to incorporate a magnetic pigment into the stated single-component toner, the said magnetic pigment being distinguished by high magnetizability, very little natural color and very low hiding power. The pigment should be suitable for coloring and should have a small specific surface area so that, because of the low pigment demand, the fixing properties of the toner particles are not adversely affected.

We have found that this object is achieved, and that colored single-component toners which are essentially composed of a magnetic pigment, a binder based on an organic polymer and/or wax and a dye or colored pigment homogeneously dispersed in the binder, as well as other conventional assistants, meet the requirements set, if the magnetic pigment consists of iron powder whose particles range in shape from spherical to elliptical and are from 2 to 12 μm in size.

In an advantageous embodiment of the novel singlecomponent toner, the special iron powder is used in combination with a white pigment of titanium dioxide and/or tin dioxide.

The special iron powder whose particles range in shape from spherical to elliptical and are from 2 to 12 μm in size can be produced in a simple manner, for example as described in German Pat. No. 500,692. Because of its shape,ie. the lack of corners and edges, such as iron powder exhibits little scattering and has high optical lightness. Furthermore, the form of the particles permits easy incorporation into the binder and has the result that virtually no abrasion or wear is detectable in the copiers and printing apparatuses. From the point of the magnetic propeties, the particle size is advantageously chosen as from 7 to 12 μm. Superparamagnetic behavior is not expected in the case of such powders and, even assuming a certain particle size spectrum, constant magnetic properties of the novel single-component toners are ensured. Furthermore, excessively finely divided iron powders have an increasingly dark appearance as the particle size decreases, and the hiding power and binder demand also increase. A suitable choice of size range can be made without difficulty, using a procedure disclosed in German Laid-Open Application DOS No. 34 28 121.

In a special embodiment of the preparation of the iron powder used in the novel single-component toner, these powders are subjected to a subsequent reductive treatment in a hydrogen atmosphere at elevated temperatures, with the result that any magnetite deposits present on the surface are removed. This is usually carried out at from 250° to 800° C., in particular from 350° to 450° C. As a result, the lightness of the magnetic pigments can be increased further.

The novel colored single-component toners are prepared in a conventional manner. For example, the components, the special iron powder, the binder, the dye and/or the colored pigment and the other assistants, are kneaded thoroughly by means of a heated roll mill, a kneading apparatus, an extruder or another apparatus, mechanically milled and classified. However, the stated substances can also be dispersed in a binder solution and the dispersion spray dried.

Suitable binders which can be used for the preparation of the novel single-component toners are homopolymers and copolymers of styrene and its substitution products, eg. polystyrene, poly-p-chlorostyrene, polyvinyltoluene, styrene/p-chlorostyrene copolymers and styrene/vinyltoluene copolymers, styrene/acrylate copolymers, eg. styrene/methyl acrylate copolymers, styrene/ethyl acrylate copolymers and styrene/n-butyl acrylate copolymers, styrene/methacrylate copolymers, eg. styrene/methyl methacrylate copolymers, styrene/ethyl methacrylate copolymers and styrene/n-butyl methacrylate copolymers, copolymers of several different monomers selected from the group consisting of styrene, acrylates and methacrylates, copolymers of styrene and other ethylenically unsaturated monomers, such as styrene/acrylonitrile, styrene/vinyl methyl ether, styrene/butadiene, styrene/vinyl methyl ketone, styrene/acrylonitrile/indene and styrene/maleate copolymers and other resins, such as polymethyl methacrylate, polybutyl methacrylate, polyvinyl acetate, polyesters, nylons, epoxy resins, polyvinylbutyral, polyacrylic acid, phenol resins, aliphatic and alicyclic hydrocarbon resins, mineral oil resins, chlorinated paraffin waxes and carnauba waxes. These binders can be used alone or in combination.

In the case of the dyes too, suitable ones are those which are familiar in reprography. Particularly suitable colorants which are soluble in binders are oilsoluble dyes which belong to the Solvent Dye group classified in the reference work Color Index, some of the disperse dyes which belong to the Disperse Dye group classified in this reference work, and some of the vat dyes belonging to the Vat Dye group classified in the said reference work. Copper phthalocyanide is an example of a blue dye, 3,3'-dichlorobenzidine, tetrazotized and coupled to 2 moles of 2,4-dimethylacetoacetanilide, is an example of a yellow dye, 2,4,5-trichloroaniline diazotized and coupled to a 3-hydroxy-2-naphthoic acid o-toluidide is an example of a red dye and chlorinated copper phthalocyanine pigment is an example of a green pigment. However, other organic and inorganic colored pigments, eg. ultramarine, iron oxides and sicotans, can also be used successfully. All other additives for the preparation of the single-component toners are summarized under the term assistants. These include, for example, antioxidants, charge control agents, anticorrosion agents or inhibitors which prevent the iron powder from rusting. These are the assistants usually used in the preparation of single-components toners. The addition of white pigments is also known per se. The effect of this in the novel colored single-component toners is on the one hand to further lighten the pigmented toners and on the other hand to reduce the electrical conductivity of the toners which, because of the iron powder present, tends to be too high. The preferred white pigment is titanium dioxide in the rutile modification, ie. in a form which is optically substantially inactive.

The amounts of the individual components in the composition of the novel single-component toners are in general from 10 to 50% by weight of binder, from 20 to 60% by weight of magnetic pigment, from 1 to 9% by weight of colored pigment or dyes and from 1 to 30% by weight of assistants.

The colored single-component toners according to the invention possess very good, brilliant hues and very good fixing properties.

The Examples which follow illustrate the invention and compare it with the prior art.

EXAMPLE 1

(a) Preparation of iron powder A

Figure 2:
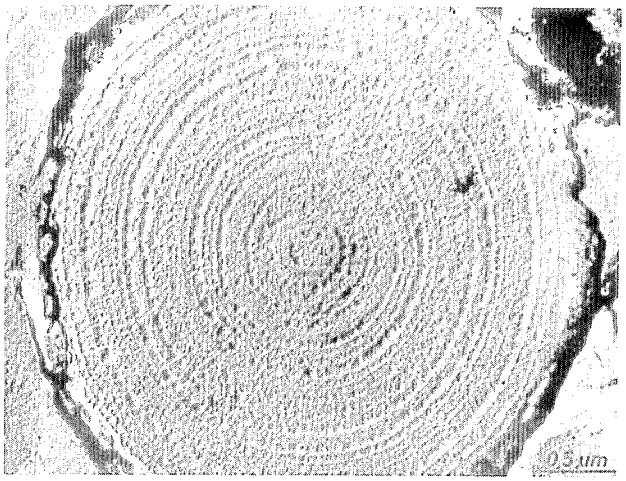

Iron pentacarbonyl is sprayed at a wall temperature of 250° C. into a heated space decomposer flooded with ammonia and is decomposed, the conditions described on page 1 of German Pat. No. 500,692 being employed. This procedure gives not only carbon monoxide but also a metallic powder which has a particle size range from 2 to 12 μm and a mean particle size of 6.4 μm. The resulting iron powder has a characteristic particle shape, as is evident from the scanning electron micrograph of the powder (FIG. 1) and the cross-section through a particle (FIG. 2). In its chemical composition, the iron powder consists of 97.5% by weight of iron, 0.9% by weight of carbon, 1% by weight of oxygen and 0.6% by weight of nitrogen.

(b) Preparation of iron powder B

Iron powder A is heated at 450° C. in a stream of hydrogen and cooled. Apart from small residual amounts, the resulting iron particles are free of carbon, oxygen and nitrogen. Analysis gives the following composition: 99.7% by weight of iron, 0.06% by weight of carbon, 0.2% by weight of oxygen and 0.04% by weight of nitrogen. The onion structure of iron powder A shown in FIG. 2 is no longer present in iron powder B, but the spherical shape is retained.

(c) Preparation of iron powder C

A preferred particle size fraction is obtained by air classification. 500 g of the iron powder described under A are initially taken in a vessel and transferred into a cyclone having a diameter of 65.0 mm by means of a stream of nitrogen. The resulting coarser fraction is obtained in 60% yield, and the iron particles are from 7 to 12 μm in size, the mean particle size being 8.2 μm. Within the error limits, the chemical composition of the particles does not differ from that of iron powder A.

For further characterization of the iron powders described under a, b and c, magnetic properties and BET surface areas, measured according to DIN 66131, section 6.5, and the results of the lightness and transparency measurements are shown in Table 1. The results of measurements on a γ-iron oxide used commercially for these purposes and a magnetite of this type are shown for comparison.

Magnetic properties were determined in a homogeneous magnetic field of 800 kA/m, using a vibrating sample magnetometer.

The lightness measurements were carried out using a type D 25-9 Hunter Lab meter (Hunter Associates Inc., Fairfax, Va., USA) on smooth, high-hiding iron powder coatings containing in each case 75% by weight of iron powder, according to the CIELAB method of measurement. The transparency was determined in accordance with DIN 6,174 by measuring the lightness L* of 100 μm thick coating films which had been pigmented in each case to an iron powder content of 10% by weight, the determinations being made over white and black back-grounds. The greater the difference ΔL between the measured lightness values, the more transparent is the pigment. The chromaticity coordinates L*, a* and b* can be determined from the tristimulus values, according to DIN 6174. The chroma $C_{ab^*}$ is defined as $$C_{ab^*} = \sqrt{a^{*2} + b^{*2}},$$

and the hue $H_{ab}$ is defined as $$H_{ab} = \arctan\left(\frac{b^*}{a^*}\right).$$

TABLE 1

| Magnetic pigment | $M_m\left[\frac{nTm^3}{g}\right]$ | $M_r\left[\frac{nTm^3}{g}\right]$ | $H_c\left[\frac{kA}{m}\right]$ | BET surface area $m^2/g$ | Lightness L* | Transparency ΔL* |
|---|---|---|---|---|---|---|
| A | 192 | 2.5 | 1.4 | 0.35 | 52.0 | 37.3 |
| B | 224 | 3.8 | 2.0 | 0.32 | 62.95 | 46.48 |
| C | 195 | 2.5 | 1.59 | 0.26 | 60.86 | 44.65 |
| γ-iron oxide | 77.3 | 27.6 | 15.1 | 4.8 | 22.16 | 0.57 |
| Commercial magnetite | 90 | 15.4 | 11.2 | 7.1 | 4.18 | 0.2 |

EXAMPLE 2

(a) 10 g of carnauba wax are heated to 140° C. in a metal vessel. 0.3 g of a commercial antioxidant is added, after which a further 44 g of carnauba wax are melted. 36 g of titanium dioxide (rutile structure) are added to the melt and dispersed with stirring. Thereafter, 20 g of 1:1 vinyl acetate/ethylene copolymer, 90 g of the iron powder described in Example 1 a and finally 10 g of a blue copper phthalocyanine pigment are mixed thoroughly with the melt. After dispersing has been carried out for 2½ hours at 120° C., the mixture is poured out and the resulting chips are subjected to a preliminary comminution procedure. After milling has been carried out in an analytical mill, a fraction smaller than 25 μm is obtainned by screening. For copying experiments, the blue toner powder is mixed thoroughly in a mixer with 2% by weight of silica which has been rendered hydrophobic. The blue toner is subjected to a copying test using a Panoly-E-102 copier from Olympus, Japan. The copies are crisp, exhibit very good hiding power in solid areas and are pale blue. The toner can be very readily fixed on standard paper. The toner is characterized in Table 2.

(b) 440 g of carnauba wax, 360 g of rutile, 3.0 g of an antioxidant, 200 g of the copolymer described in Example 2a, 100 g of the copper phthalocyanine pigment and 900 g of the iron powder described in Example 1b are dispersed for 2½ hours at 120° C., as described in Example 2a. The cold crude product obtained in the form of chips is subjected to preliminary comminution and milled to a particle size of less than 25 μm in a fluidized bed countercurrent mill equipped with a screen classifier. The fine fraction under 5 μm is separated off by air classification. The fraction having particle sizes from 5 to 25 μm is mixed thoroughly in a mixer with 1.5% by weight of silica which has been rendered hydrophobic.

This toner is subjected to a copying test in a Panoly-E-102 copier. It gives brilliant pale blue crisp copies which are uniform and high-hiding on solid areas. The blue toner can very readily be fixed on the paper. The characteristics are summarized in Table 2.

(c) 44 g of carnauba wax, 0.3 g of an antioxidant, 20 g of a vinyl acetate/ethylene copolymer, 36 g of rutile, 10 g of copper phthalocyanine pigment and 90 g of the iron powder described in Example 1c are dispersed in the manner described in Examples 2a and 2b. After milling as described in Example 2a and coating with 2% by weight of silica which has been rendered hydrophobic, copying tests were carried out on a Panoly-E-102 copier. The copies exhibit excellent crispness and are a brilliant pale blue, as in Example 2, and the solid areas are uniform and highhiding. The toner can very readily be fixed on the paper. The results of the characterization are summarized in Table 2.

(d) In order to be able to assess the color properties, an iron-free toner having a similar composition is prepared. To do this, 134 g of carnauba wax, 20 g of the vinyl acetate/ethylene copolymer, 36 g of rutile, 10 g of the copper phthalocyanine pigment and 0.3 g of an antioxidant are melted and dispersed, cooled and then milled. A very high-hiding, smooth toner layer serves for comparison with the color measurements of the toners of Examples 2a, 2b and 2c. The results of the measurements are summarized in Table 2.

The magnetic properties were measured in a homogeneous magnetic field of 160 kA/m, using a vibrating sample magnetometer.

To determine the specific conductivity, the toner powder was compressed in a highly insulated tableting press under 10 bar at room temperature and the area and thickness of the tablet were determined. A voltage of 100 V was applied to the toner tablet via gold contacts, and the current flow was then measured. The specific conductivity is calculated from the measured data in accordance wiht the expression $$H = \frac{e \cdot J}{U \cdot q},$$

where e is the thickness of the tablet, q is the tablet cross-section, U is the voltage and J is the current.

The color properties were determined for compressed toner material (under 2 bar), in the manner stated. The results of measurements on a toner which does not contain the special iron powder are shown for comparison. Moreover, toners which contain commercial magnetite and maghemite ($\gamma$-$Fe_2O_3$) as the magnetic pigment were prepared for comparison. The color properties are also shown in Table 2 for comparison.

The fixing properties are checked by pressing a commercial self-adhesive tape (Tesafilm) onto the copy and then pulling off the tape.

TABLE 2

| | Ex. 2a | Ex. 2b | Ex. 2c | Ex. 2d | Toner containing 45% by weight of magnetite | Toner containing 45% by weight of maghemite |
|---|---|---|---|---|---|---|
| $M_m \left[\frac{nTm^3}{g}\right]$ | 47 | 47 | 46 | — | — | — |
| $M_r \left[\frac{nTm^3}{g}\right]$ | 0.5 | 0.5 | 0.5 | — | — | — |
| $H_c \left[\frac{kA}{m}\right]$ | 2.7 | 3.7 | 2.8 | — | — | — |
| $H[S \cdot cm^{-1}]$ | $<10^{-14}$ | $1.9 \cdot 10^{-13}$ | $<10^{-14}$ | $<10^{-14}$ | $<10^{-14}$ | $10^{-14}$ |
| Lightness L* | 37.5 | 39.0 | 39.4 | 39.5 | 26.6 | 30.8 |
| Chroma $C_{ab}$* | 31.8 | 31.2 | 33.0 | 42.8 | 4.9 | 4.3 |
| Hue $H_{ab}[\cdot]$ | 262.2 | 263.6 | 262.6 | 266.9 | 100.0 | 112.2 |

EXAMPLE 3

The procedure described in Example 2a is followed, except that, instead of the titanium dioxide, the following amounts of other assistants are used:

(a) 36 g of tin dioxide (b) 18 g of titanium dioxide and 18 g of zinc oxide (c) 18 g of titanium dioxide and 18 g of sicorin (zinc salt of o-nitrophthalic acid)

(d) 18 g of titanium dioxide, 6 g of zinc oxide, 6 g of zinc borate and 6 g of sicorin.

The magnetic and color properties and the specific conductivities are summarized in Table 3 and compared with the non-magnetic blue toner according to Example 2d.

TABLE 3

| | Ex. 3a | Ex. 3b | Ex. 3c | Ex. 3d | Ex. 2d |
|---|---|---|---|---|---|
| $M_m \left[\frac{nTm^3}{g}\right]$ | 50 | 52 | 51 | 49 | — |
| $M_r \left[\frac{nTm^3}{g}\right]$ | 0.5 | 0.5 | 0.4 | 0.4 | — |
| $H_c \left[\frac{kA}{m}\right]$ | 3.1 | 2.7 | 2.4 | 2.7 | — |
| $H \left[\frac{S}{cm}\right]$ | $<10^{-14}$ | $<10^{-14}$ | $<10^{-14}$ | $<10^{-14}$ | $<10^{-14}$ |
| L* | 26.3 | 33.7 | 35.2 | 32.0 | 38 |
| $C_{ab}$* | 25.0 | 29.8 | 30.4 | 30.3 | 42.1 |
| $H_{ab}[\cdot]$ | 273.1 | 266.3 | 266.9 | 266.1 | 266.9 |

The lightness (L*) of the toners in Examples 3a to 3d is less than that of the toners which contain exclusively titanium dioxide, so that a deep blue color impression results. The copies exhibit a dark blue color very similar to that of a blue ballpoint pen.

EXAMPLE 4

The procedure described in Example 2a is followed, except that, instead of the blue copper phthalocyanine pigment, the following colored pigments are used:

(a) 3,3'-dichlorobenzidine, tetrazotized and coupled to 2 moles of 2,4-dimethylacetoacetanilide (b) 2,4,5-trichloroaniline, diazotized and coupled to 3-hydroxy-2-naphthoic acid o-toluidide (c) chlorinated copper phthalocyanine pigment.

The relevant measured values are shown in Table 4.

TABLE 4

| | Example 4a | Example 4b | Example 4c |
|---|---|---|---|
| $M_m \left[\frac{nTm^3}{g}\right]$ | 48 | 49 | 41 |
| $M_r \left[\frac{nTm^3}{g}\right]$ | 0.3 | 0.3 | 0.5 |
| $H_c \left[\frac{kA}{m}\right]$ | 1.9 | 2.1 | 2.6 |
| $H \left[\frac{S}{cm}\right]$ | $<10^{-14}$ | $<10^{-14}$ | $<10^{-14}$ |
| $L^*$ | 61.0 | 39.5 | 43.9 |
| $C_{ab}^*$ | 49.1 | 29.1 | 28.0 |
| $H_{ab}[\cdot]$ | 103.1 | 9.9 | 188.7 |

A copying test carried out using a Panoly-E-102 copier gives crisp pastel-like yellow, red and green copies with excellent fixing properties.

EXAMPLE 5

10 g of copper phthalocyanine pigment, 90 g of iron powder according to Example 1b, 36 g of titanium dioxide and 0.3 g of an antioxidant are dispersed in 64 g of a styrene/ethyl hexylacrylate copolymer at 150° C., as described in Example 2a. A very opaque toner tablet is produced by compressing (2 bar) as described in Example 2, and the tristimulus values are measured. The color properties of Examples 2b and 2d, which contain the same magnetic pigment and no magnetic pigment, respectively, are shown for comparison.

TABLE 5

| | Example 4 | Example 2b | Example 2d |
|---|---|---|---|
| $M_m \left[\frac{nTm^3}{g}\right]$ | 46 | 47 | — |
| $M_r \left[\frac{nTm^3}{g}\right]$ | 0.5 | 0.5 | — |
| $H_c \left[\frac{kA}{m}\right]$ | 3.7 | 3.7 | — |
| $H \left[\frac{S}{cm}\right]$ | $<10^{-14}$ | $<10^{-14}$ | $<10^{-14}$ |
| $L^*$ | 30.1 | 39.0 | 39.5 |
| $C_{ab}^*$ | 43.3 | 31.2 | 42.8 |
| $H_{ab}[\cdot]$ | 270.7 | 263.6 | 266.9 |

EXAMPLE 6

80 g of carnauba wax are melted with stirring at 100° C. in a 1 l tin can. The addition of 0.3 g of an antioxidant and 20 g of a vinyl acetate/ethylene copolymer gives a viscous slurry. Thereafter, 90 g of the iron powder described in Example 1b and 10 g of a copper phthalocyanine pigment are added in succession in small portions and stirred in. The viscous mixture is dispersed at 120° C. for 2½ hours using an anchor stirrer. The cooled product obtained in the form of chips is milled in an analytical mill and a screen fraction smaller than 25 μm is obtained. The following properties were determined:

| | | | |
|---|---|---|---|
| Magnetic properties: | $M_m$ | = | $46 \frac{nTm^3}{g}$ |
| | $M_r$ | = | $0{,}5 \frac{nTm^3}{g}$ |
| | $H_c$ | = | $3{,}7 \frac{kA}{m}$ |
| specific conductivity | $H$ | < | $10^{-14} \frac{S}{cm}$ |
| color properties of | $L^*$ | = | 21,15 |
| a high-hiding toner | $C_{ab}^*$ | = | 15,88 |
| layer | $H^\circ$ | = | 284,2 |

The dark blue single-component toner is subjected to a copying test on a Panoly-E-102 copier. The copies are crisp, high-hiding in solid areas and can be very readily fixed on standard paper.

We claim:

1. A colored single-coponent toner consisting essentially of a magnetic pigment, a binder based on an organic polymer and/or wax, a dye or colored pigment homogeneously dispersed in the binder, wherein the magnetic pigment consists of iron powder whose particles range in shape from spherical to elliptical and are from 2 to 12 μm in size.

2. A colored single-component toner as claimed in claim 1, wherein the magnetic pigment consists of iron powder whose particles range in shape spherical to elliptical and are from 7 to 12 μm in size.

3. A colored single-component toner as claimed in claim 1, wherein the iron powder is prepared by thermal decomposition of iron pentacarbonyl vapor in the presence of ammonia and inert gas and contains 0.5–1.0% of C, 0.5–1.0% of N and 0.3–1.2% of O.

4. A colored single-component toner as claimed in claim 3, wherein the iron powder is subjected to subsequent reduction with hydrogen at from 250° to 800° C. and contains 0.03–0.1% of C, 0.03–0.1% of N and 0.1–0.25% of O.

5. A colored single-component toner as claimed in claim 1, further containing at least one of an antioxidant, a charge control agent, an anticorrosion agent, an inhibitor which prevent the iron powder from rusting, or a white pigment.

* * * * *